US012082752B2

(12) United States Patent
Lazzareschi

(10) Patent No.: US 12,082,752 B2
(45) Date of Patent: Sep. 10, 2024

(54) DISPENSER FOR CELLULOSE PRODUCTS IN SHEET FORM

(71) Applicant: SOFIDEL S.P.A., Porcari (IT)

(72) Inventor: Luigi Lazzareschi, Porcari (IT)

(73) Assignee: SOFIDEL S.P.A., Porcari (IT)

( * ) Notice: Subject to any disclaimer, the term of this patent is extended or adjusted under 35 U.S.C. 154(b) by 0 days.

(21) Appl. No.: 17/769,206

(22) PCT Filed: Oct. 15, 2019

(86) PCT No.: PCT/IB2019/058766
§ 371 (c)(1),
(2) Date: Apr. 14, 2022

(87) PCT Pub. No.: WO2021/074670
PCT Pub. Date: Apr. 22, 2021

(65) Prior Publication Data
US 2024/0115088 A1 Apr. 11, 2024

(51) Int. Cl.
*A47K 10/42* (2006.01)
*A47K 10/32* (2006.01)

(52) U.S. Cl.
CPC ..... *A47K 10/427* (2013.01); *A47K 10/422* (2013.01); *A47K 2010/3233* (2013.01); *A47K 2010/3246* (2013.01)

(58) Field of Classification Search
CPC ..... A47K 10/427
USPC ..... 221/33–63
See application file for complete search history.

(56) References Cited

U.S. PATENT DOCUMENTS 2,095,649 A 10/1937 Oswell
9,629,509 B1 4/2017 Keily et al.
10,004,366 B2 6/2018 Chalko et al.
(Continued)

FOREIGN PATENT DOCUMENTS

WO 2017151088 A1 9/2017

*Primary Examiner* — Gene O Crawford
*Assistant Examiner* — Ayodeji T Ojofeitimi
(74) *Attorney, Agent, or Firm* — McGlew and Tuttle, P.C.

(57) ABSTRACT

A dispenser (10) for cellulose products in sheet form comprising: —a container (11) defined by a substantially rectangular lower wall (12), two pairs of opposite lateral walls that extend from the lower wall (12) toward an upper end edge (15) defining an upper mouth (15A) of the container (11), opposite the lower wall (12), respectively a first pair of lateral walls (13) and a second pair of lateral walls (14); —a closing cover (16), comprising an opening (17) for picking up cellulose products in sheet form contained in the container (11), adapted to close said container (11) at said upper end edge (15), —a pushing assembly (25) for pushing the cellulose products upward, comprising an upper plate (26) adapted to slide vertically along opposite guides (29) provided on opposite lateral walls of the first pair of walls (13) and at least one elastic element (28) positioned between said lower wall (12) and said upper plate (26), adapted to push said upper plate (26) upward, wherein said pushing assembly comprises a lower plate (27) arranged above said lower wall (12) and also slidingly constrained to said opposite guides (29), adapted to form the lower stop for said at least one elastic element (28), so that the latter is adapted to act directly between said lower plate (27) and said upper plate (26).

17 Claims, 4 Drawing Sheets

(56) References Cited

U.S. PATENT DOCUMENTS

| | | | | |
|---|---|---|---|---|
| 11,641,986 | B2 * | 5/2023 | Bing | A47K 10/422 221/52 |
| 2016/0088982 | A1 * | 3/2016 | Larsson | B65B 5/06 221/45 |
| 2016/0374524 | A1 * | 12/2016 | Stenberg | B65D 83/0817 221/59 |
| 2020/0196810 | A1 * | 6/2020 | Dallaire | A47K 10/422 |
| 2021/0106188 | A1 * | 4/2021 | Zerweck | A47K 10/44 |

* cited by examiner

DISPENSER FOR CELLULOSE PRODUCTS IN SHEET FORM

TECHNICAL FIELD

The present invention concerns dispensers for tissues, napkins or other cellulose products in sheet form. Embodiments described herein in particular relate to dispensers for tissues or other cellulose products in sheet form, typically folded or interfolded, having a rectangular prismatic form adapted to contain a stack or pack of rectangular sheets, for example interfolded tissues.

STATE OF THE ART

Disposable napkins or tissues are often products in packs or stacks containing interfolded handkerchiefs, folded so that, once inserted in a dispenser, it is possible to extract single napkins or handkerchiefs one at a time through an opening of the dispenser. Parallelepiped shaped dispensers, with an upper wall provided with an opening through which the tissues are picked up, are often used to contain and dispense the tissues.

In the present context, upper and lower are meant as the positions taken by the dispenser or by its parts in a possible and preferred configuration for use. Typically, these dispensers are configured to be used resting on a surface with a lower wall or base of its own, opposite which is the upper wall provided with the dispensing opening. The term vertical means a direction from bottom to top, generally approximately orthogonal to the surface on which the dispenser rests.

In some current state of the art dispensers the upper wall, provided with the opening for picking up the tissues, consists of a cover, while inside the dispenser there is provided a plate on which the tissues are loaded, mounted so as to slide in vertical direction (when in use) from a bottom position, when the dispenser is full of tissues, i.e., contains a new stack of tissues, to a top position, when the dispenser is empty. The plate is maintained constantly toward the top position by a spring positioned between the lower wall of the dispenser and the plate, so that the tissues are constantly held in contact with the inner face of the cover, abutting against the dispensing opening.

In general, these dispensers have problems linked to the loading step of the tissues. In fact, during loading, the sliding plate tends to "jump" out of the dispenser, or tends to jam in the guides, or otherwise tends to transmit an overturning moment to the dispenser.

A dispenser that attempts to overcome these problems is described, for example, in U.S. Ser. No. 10/004,366. However, this dispenser has a complex construction and, in any case, is somewhat impractical during the filling step.

Moreover, this type of dispenser is ill-suited for optimum regular cleaning. In fact, these dispensers are often used in public places adapted for the consumption of food and beverages. Often these devices come into contact with liquids or foods that result in contamination of the dispenser, with the related problems caused by bacterial contamination.

If these dispensers must be washed, it must be possible to disassemble and reassemble them. This type of dispensers generally has a difficult reassembly step, in particular during repositioning of the springs that move the sliding plate that holds the tissues.

SUMMARY

The object of the present invention is to improve and perfect dispensers of the current state of the art to obtain a more functional low cost dispenser. Within this aim, an important object of the invention is to produce a dispenser for cellulose products in sheet form that is stable during the loading step of the cellulose products.

Another important object of the present invention that of producing a dispenser for cellulose products in sheet form that is easy to disassemble and reassemble, to allow easy cleaning thereof.

Yet another important object of the present invention is to produce a dispenser for cellulose products in sheet form that is structurally simple.

One more object of the present invention is to produce a dispenser for cellulose products in sheet form that can be adapted to the requirements of the different commercial establishments that use it.

These and other objects, which will be more apparent below, are achieved with a dispenser of cellulose products in sheet form comprising

- a container defined by a substantially rectangular lower wall, two pairs of opposite lateral walls that extend from the lower wall toward an upper end edge defining an upper mouth of the container, opposite the lower wall, respectively a first pair of lateral walls and a second pair of lateral walls;
- a closing cover, comprising an opening for picking up cellulose products in sheet form contained in the container, adapted to close the container at the upper end edge,
- a pushing assembly for pushing the cellulose products upward, comprising an upper plate adapted to slide vertically along opposite guides provided on opposite lateral walls of the first pair of walls and at least one elastic element positioned between the lower wall and the upper plate, adapted to push the plate upward,
- wherein the pushing assembly comprises a lower plate arranged on the lower wall and also slidingly constrained to said opposite guides, adapted to form the lower stop for the at least one elastic element, so that the latter is adapted to act directly between the lower plate and the upper plate.

This structure of the pushing assembly allows the step of loading the napkins into the container to be improved. In fact, the lower plate enables the center of gravity of the dispenser to be lowered, and also enables the effects of jamming to be limited and reduces the overturning moment during loading.

The presence of a double plate also facilitates reassembly of the dispenser after washing. In particular, with prior art single plate dispensers there are considerable problems of repositioning the elastic element in the specific spaces, while with the double plate this problem is overcome.

Advantageously, the upper plate and the lower plate can have respective positioning abutments for the ends of the elastic element.

Preferably, the at least one elastic element is a coil spring, for example with a trapezoidal trend, or with the spring that is tapered from the bottom (with a larger base) toward the top.

Preferably, two elastic elements, or two springs, are present, positioned parallel to each other, thus contributing to increase the stability of the loading step of the cellulose products in sheet form.

Advantageously, in certain embodiments, the upper plate and the lower plate are identical, and are arranged with identical faces facing each other, thereby optimizing components and production.

The dispenser according to one or more of the preceding claims, wherein the lower wall and the lateral walls are in one piece. Advantageously the cover can be separable from the container. Advantageously, the pushing assembly is separable from the container.

Preferably, the closing cover comprises an annular stop surface on the upper part of the perimeter edge and a frame that projects downward laterally to the upper annular stop surface, counter-shaped, or complementary, to the upper mouth defined by the perimeter edge.

In some preferred embodiments, on at least one of the opposite lateral walls of the second pair of lateral walls, there is provided a cutout, preferably closed by a transparent sheet, adapted to allow viewing of the inside, so as to be able to see how many cellulose products in sheet form are present; preferably, on the inner side of the cutout, at the opposite side surfaces of the cutout, there are provided vertical runners for the removable insertion of a filling element of the cutout, adapted to at least partially obstruct the view through said cutout: in his way, advertising messages, logos, drawings or any other graphical signs can be affixed to the filling element, according to need. The fact that the filling element is removable allows the dispenser to be easily customized; preferably, the filling element comprises at least one through slot adapted to allow viewing of the inside of the container. According to preferred embodiments, there are provided two said cutouts, one for each wall of the second pair of opposite walls; preferably, the transparent sheets of the two cutouts are in one piece with a bridge element that connects the two transparent sheets at the bottom and that is arranged on the lower wall, the transparent sheets—bridge element assembly being separable from the container to facilitate washing.

According to preferred embodiments, the cover comprises an opening button provided, when the cover is closed, on a wall of said second pair; preferably, the button is defined on a tab projecting downward from the perimeter of the cover and is adapted to be inserted into a complementary through impression defined on this wall of the second pair of lateral walls.

According to preferred embodiments, the cover comprises a hinging device to the container; preferably the hinging device comprises wings projecting from the cover in proximity of two corner zones thereof, on each wing there is provided a corresponding first hinge part, adapted to be rotatingly coupled to a corresponding second hinge part provided in proximity of the perimeter edge of the container; coupling between said first and second hinge part is preferably of elastically yielding type, to allow the cover to be decoupled from/coupled to the container.

According to preferred embodiments, the opposite guides of the pushing assembly comprise upper end-of-travel locking elements for the upper plate.

According to preferred embodiments, the container comprises at least one hole in proximity of the lower wall, to allow the drainage of liquids.

BRIEF DESCRIPTION OF THE DRAWINGS

The invention will be better understood by following the description and the accompanying drawings, which illustrate an exemplifying and non-limiting embodiment of the invention. More particularly, in the drawings.

DETAILED DESCRIPTION OF EMBODIMENTS

Figure 1:
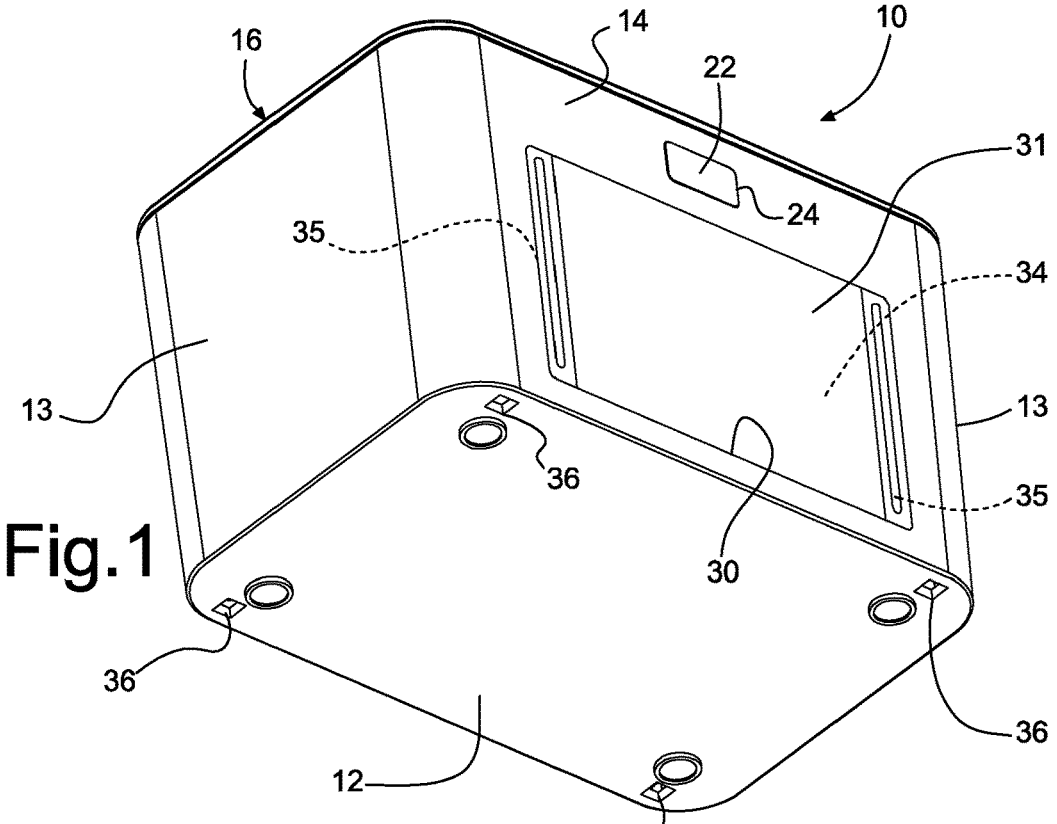
FIG. 1 represents an axonometric view from below of a dispenser according to the invention, with the cover in the closing step.
Figure 2:
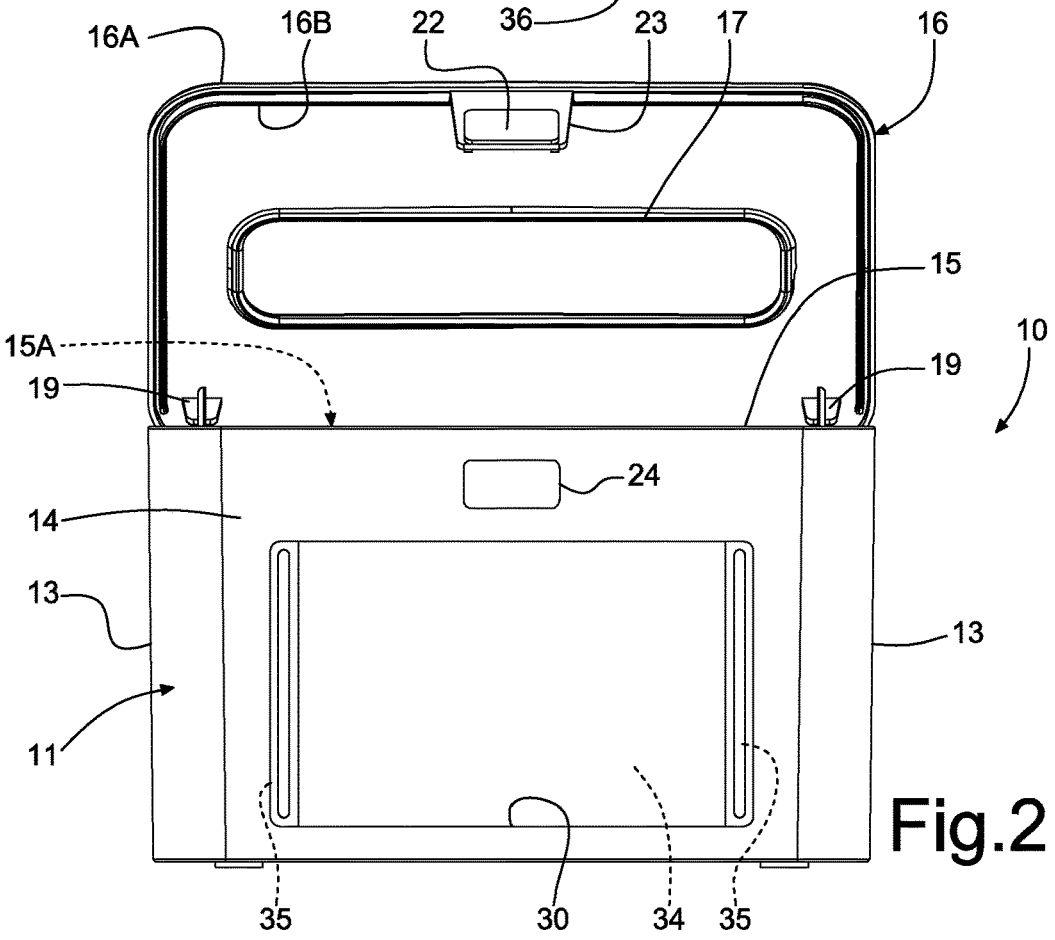
FIG. 2 represents a front view of the dispenser of FIG. 1, with the cover open.

With reference to the aforesaid figures, a dispenser of cellulose products in sheet form according to the invention is indicated as a whole with the number 10.

This dispenser 10 comprises a container 11 defined by a substantially quadrangular and preferably rectangular lower wall 12, two pairs of opposite lateral walls, which extend from the lower wall 12 toward an upper end edge 15 defining an upper mouth 15A of the container, opposite the lower wall 12. In particular, there are provided respectively a first pair of lateral walls 13 and a second pair of lateral walls 14, to form in practice a substantially prismatic container with a rectangular base. The rectangular shape is suitable to accommodate cellulose products in sheet form, such as folded interleaved tissues with a plan shape complementary to the shape of the lower wall 12, not shown in the figure.

Constrained to the container 11 is a closing cover 16 adapted to close the container 11 at the upper end edge 15. This cover 16 is provided, in a preferably central position, with a through opening 17, of a shape and dimension suitable to pick up tissues contained in the container.

In particular, the cover 16 is hinged to the container 11. In practice, the cover 16 is provided with a hinging device to the container 11 that comprises two wings 19 projecting from the cover in proximity of two corner areas thereof along a same side and wherein, on each wing 19, there is provided a corresponding first hinge part 20 (for example a pin), adapted to be rotatingly coupled to a corresponding second hinge part 21 (for example a seat for rotatingly housing the pin), provided in proximity of a corresponding corner area of the perimeter edge 15 of the container.

Coupling between the first hinge part 20 and the second hinge part 21 can be of elastically yielding, or snap fastening, type, to allow the cover to be decoupled from/coupled to the container.

Alternatively, coupling between the first hinge part 20 and the second hinge part 21 can for example be of bayonet-like type, so that in a given position of the cover during opening with respect to the container, the coupling between first and second part is released and the two parts can be separated.

The cover 16 also comprises an opening button 22 (in practice this button is a closing device of the cover on the container). This button is defined on a tab 23 projecting downward from the perimeter of the cover, on the opposite side to the hinge. When the cover is closed, the button 22 is inserted into a complementary impression 24, defined passing through the wall of the second pair of lateral walls 14 farther away with respect to the hinge axis of the cover. Pressing the button, the tab 23 flexes, and the button exits from the through impression 24, thereby releasing the cover, which can be rotated about the hinge axis, allowing access to the inside of the container.

The closing cover 16 comprises an annular surface 16A for abutment against the upper part of the perimeter edge 15, and a frame 16B that projects downward laterally to the annular surface 16A, advantageously complementary to the upper mouth 15A defined by the perimeter edge 15. In this way the possibility of liquids accidentally seeping between the perimeter edge 15 and the cover 16 is reduced.

Inside the container 11 there is provided a pushing assembly 25 for pushing the tissues upward, which comprises a pair of plates, respectively an upper plate 26 and a lower plate 27, one superimposed on the other, adapted to slide vertically inside the container 11, between which there are arranged two elastic elements in the form of trapezoidal coil springs 28, or flared from the top toward the bottom, or with the lower base of larger dimensions.

The two plates 26 and 27 are constrained on opposite sides, to vertical guides 29, produced on the first opposite walls 13. Each vertical guide 29 is formed by two opposite L-shaped appendages 29A, facing each other, which project from the same wall of the first pair. The short sides of the plates 26 and 27 have shapings 26A and 27A to be able to slide inside the space delimited by these L-shaped appendages. The vertical guides 29 are common for both the plates 26 and 27.

On the sides of the two plates 26 and 27 facing each other there are defined abutments 28A for positioning of the springs 28.

For example, the upper plate 26 and the lower plate 27 are identical, and are arranged with identical faces facing each other, thereby optimizing components and production (only one mold is required).

The lower plate 27 is abutting against the lower wall 12, while the upper plate 26 is held upward by the springs 28. The tissues are arranged on the upper face of the upper plate 26. The springs 28 rest on the lower plate 27 (which is provided on the bottom part 12), and push the upper plate upward, obliging the tissues to remain in contact with the inner face of the cover 16.

At the upper ends of the opposite guides 29 there are provided upper end-of-travel locking elements 29B for the upper plate 26, such as to prevent the plate from "jumping out" of the container, when the cover is open.

The use of the guided lower plate on the one hand allows lowering of the center of gravity of the dispenser (there is an additional mass on the lower wall of the dispenser) and on the other to reduce the overturning moment of the dispenser during the loading step of the tissues, and the effects of jamming in sliding of the plate that supports the tissues.

In this example, on both the walls of the second pair of lateral walls 14, there are provided two cutouts 30 (one per wall), in practice quadrangular holes, closed by respective transparent sheets 31, which allow the inside of the container 11 to be at least partially viewed.

Figure 3:
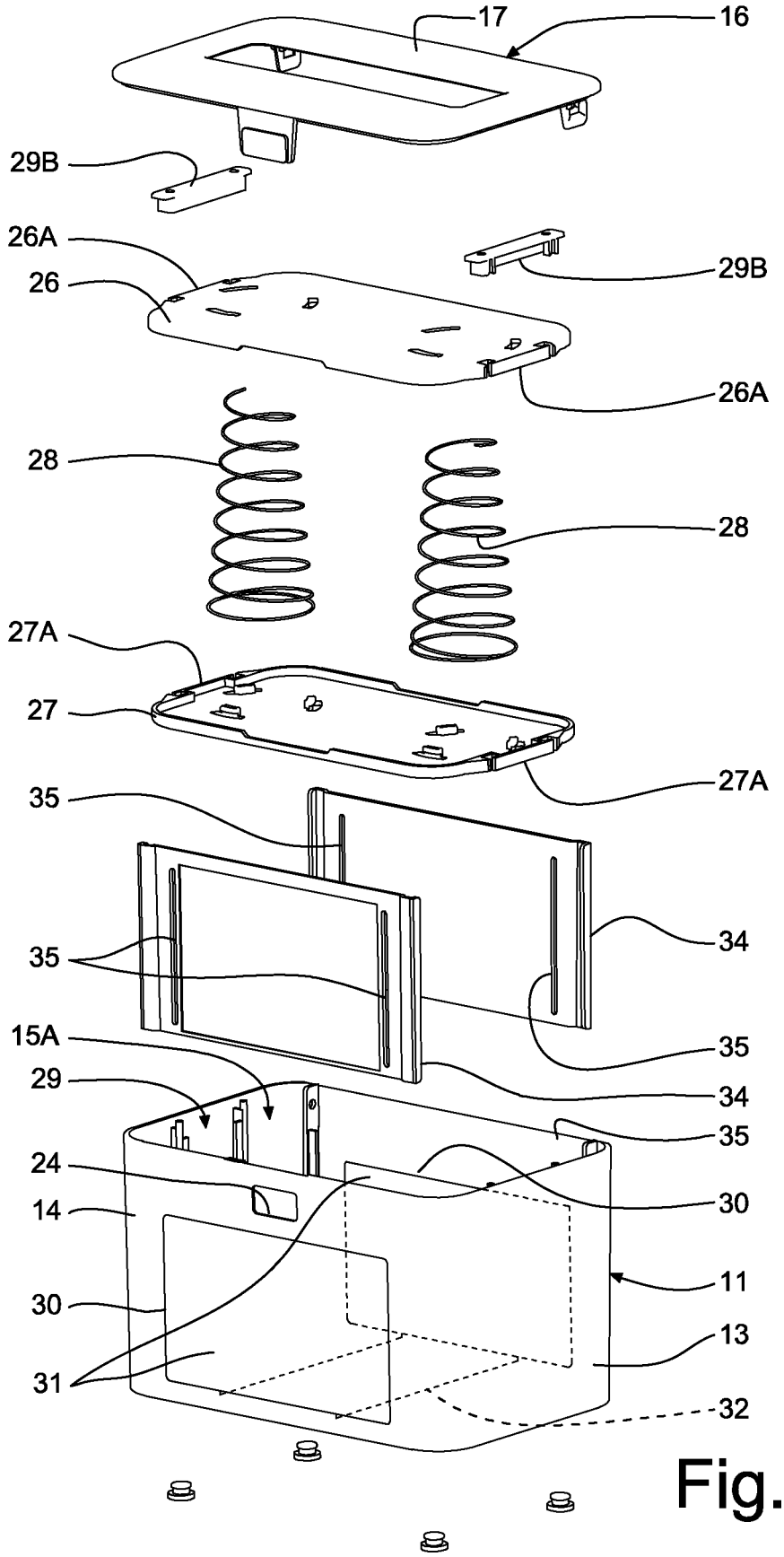
FIG. 3 represents an exploded axonometric view of the dispenser of FIG. 1.
Figure 4:
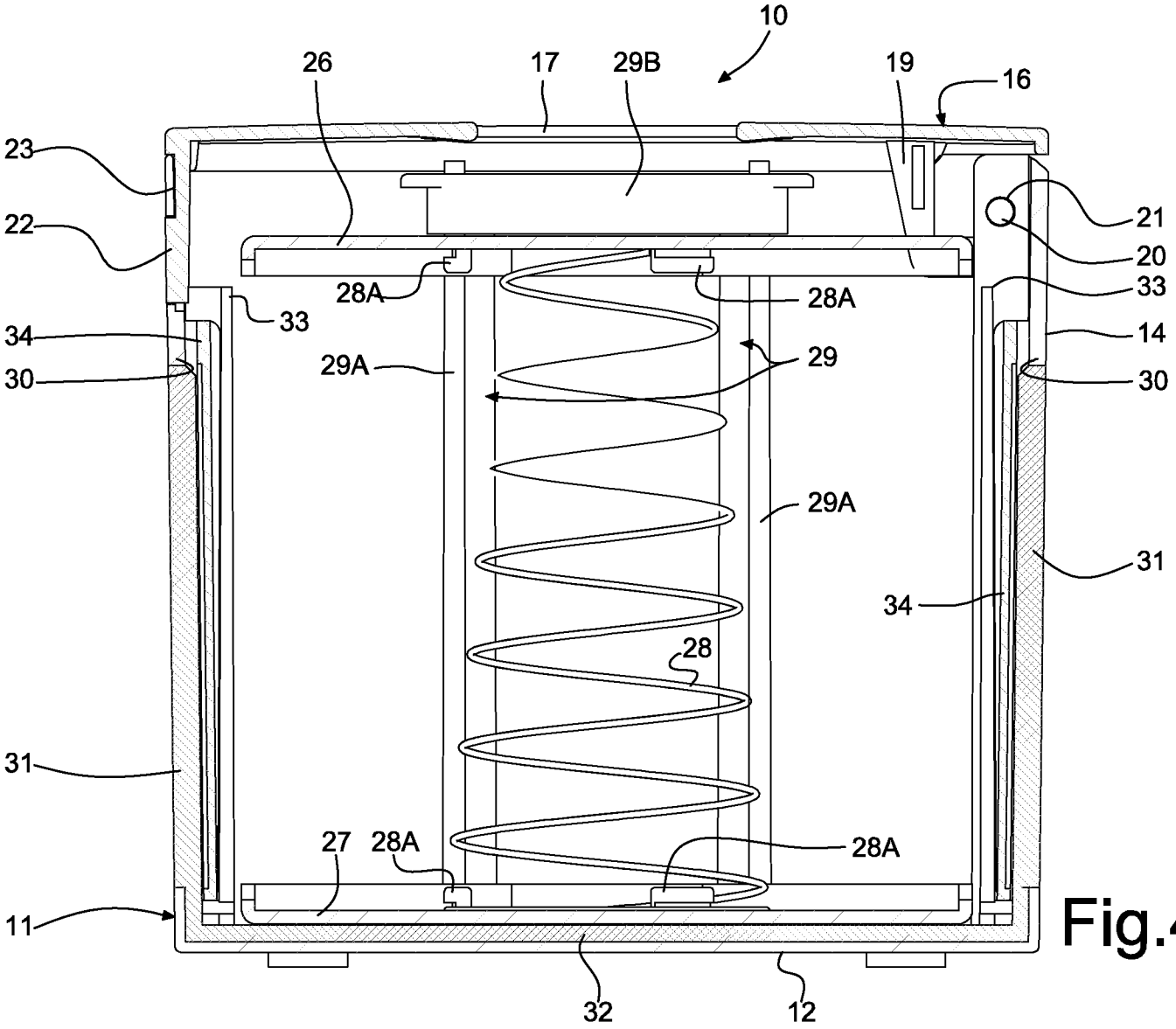
FIG. 4 represents a sectional side view of the dispenser of FIG. 1, with the cover closed and without products inside.
Figure 5:
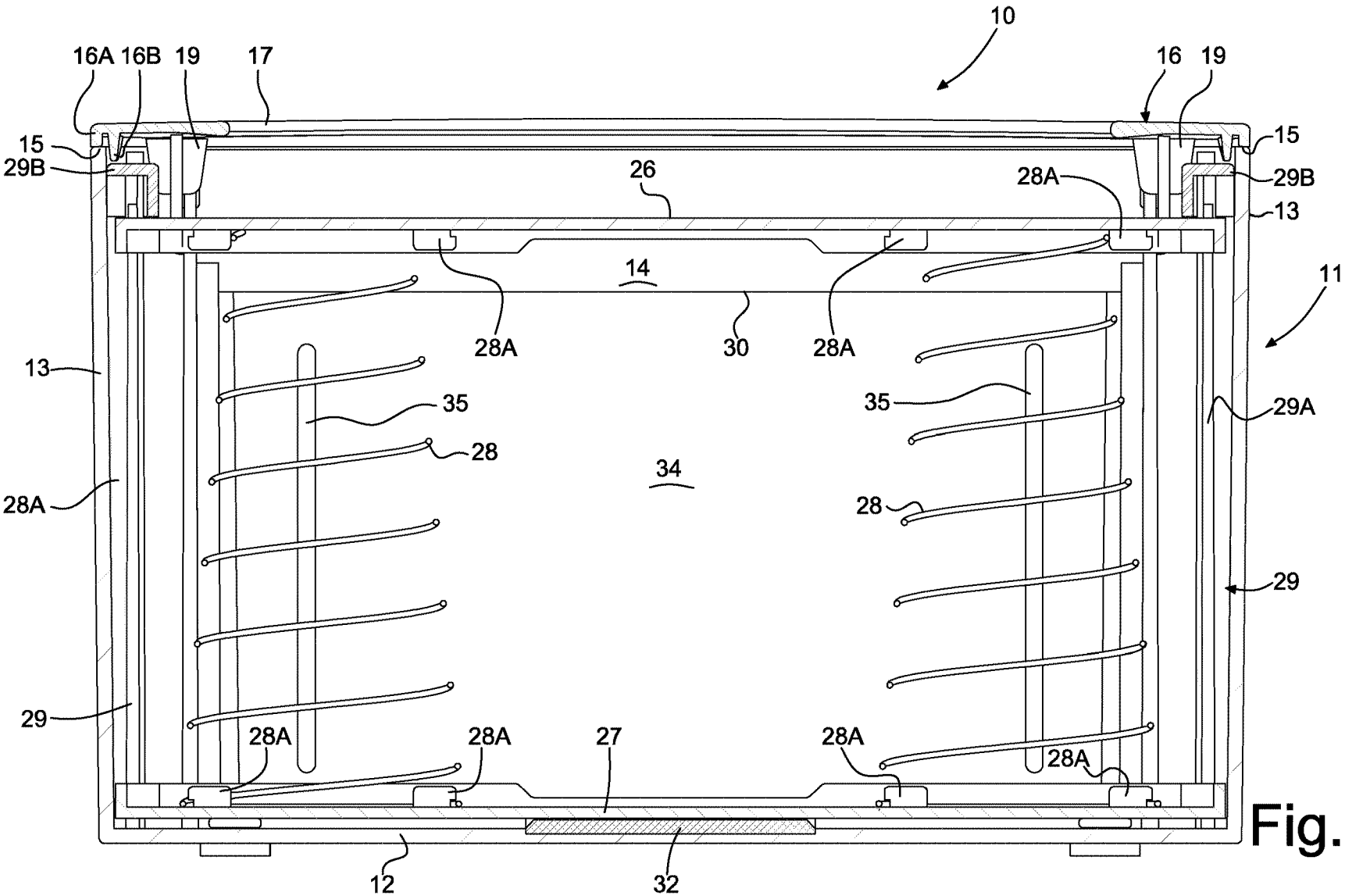
FIG. 5 represents a sectional front view of the dispenser of FIG. 1, with the cover closed and without products inside.

These transparent sheets 31 are in one piece with a bridge element 32 that connects the two sheets at the bottom and that is arranged on the lower wall 12 (between this and the lower plate 27), in practice to define a body with an upward facing U-shaped section. The sheets 31—bridge element 32 assembly is separable from the container (in the exploded view of FIG. 3, the bridge element is marked schematically with a dashed line, inside the container).

On the inner side of each cutout 30, at the opposite side surfaces of the cutout, there are provided vertical runners 33 for the removable insertion of a filling element 34 of the cutout, for example in the form of a prevalently square sheet that is arranged vertically, adapted to at least partially obstruct the view through the cutout.

The filling element 34 is removable from the runners 33. Advertising messages, logos, drawings or any other graphical signs can be affixed to the filling element according to need. For example, on this filling element the logo of the specific commercial establishment in which the dispenser is used can be affixed. Therefore, it is possible to produce a single model of dispenser with the exception of the filling element, which can be produced according to specific orders.

Advantageously, the filling element 34 can comprise one or more slots 35, passing through the thickness thereof, oriented vertically, so as to allow the amount of tissues remaining inside the dispenser to be viewed.

Advantageously, the container comprises a plurality of holes 36 in proximity of the lower wall, to allow the drainage of liquids that may accumulate after washing.

The container 11 is produced in one piece preferably made of injection moldable plastic material. Therefore, the lateral walls 13 and 14, the lower wall 12, the guides 29 and the runners 33 are in one piece.

Likewise, the cover 16 is in one piece preferably made of injection moldable plastic material, preferably separable from the container 11.

The sheets 31—bridge element 32 assembly is also in one piece preferably made of injection moldable plastic material, separable from the container 11.

The upper and lower plates 26 and 27 are also each in one piece preferably made of injection moldable plastic material, separable from the container 11.

The upper end-of-travel locking elements 29B for the upper plate 26, to be coupled to the upper ends of the opposite guides 29 are also each in one piece preferably made of injection moldable plastic material, separable from the container 11.

The springs are, in this example, made of steel, and are separable from the plates 26 and 27.

In practice, the dispenser 10 is formed by a plurality of separable components with a very simple structure, which can each be washed, for example, in a dishwasher or autoclave.

It is understood that what is illustrated only represents possible non-limiting embodiments of the invention, which can vary in forms and arrangements without departing from the scope of the concept on which the invention is based. Any reference numerals in the appended claims are provided purely to facilitate reading thereof, in the light of the above description and of the accompanying drawings, and do not in any way limit the scope of protection.

The invention claimed is:

1. A dispenser for cellulose products in sheet form, the dispenser comprising:

a container defined by a substantially rectangular lower wall, two pairs of opposite lateral walls that extend from the lower wall toward an upper end edge defining an upper mouth of the container, opposite the lower wall, respectively a first pair of lateral walls and a second pair of lateral walls;

a closing cover, comprising an opening for picking up cellulose products in sheet form contained in the container, adapted to close said container at said upper end edge, a pushing assembly for pushing the cellulose products upward, the pushing assembly comprising:

an upper plate adapted to slide vertically along opposite guides provided on opposite lateral walls of the first pair of walls;

at least one elastic element positioned between said lower wall and said upper plate, adapted to push said upper plate upward; and a lower plate arranged above said lower wall and also slidingly constrained to said opposite guides, adapted to form the lower stop for said at least one elastic element, so that the latter is adapted to act directly between said lower plate and said upper plate, wherein two cutouts, one for each wall of said second pair of opposite walls, are provided on said opposite walls, said two cutouts being adapted to allow viewing of the inside of the container;

transparent sheets, each closing a respective one of the two cutouts; and a bridge element, the transparent sheets of said two cutouts being in one piece with the bridge element and the bridge element connecting the two transparent sheets at a bottom as a bridge element assembly and being arranged on said lower wall, the bridge element assembly being separable from said container.

2. The dispenser according to claim 1, wherein said opposite guides of said pushing assembly comprise upper end-of-travel locking elements for said upper plate.

3. The dispenser according to claim 1, wherein said container comprises at least one hole in proximity of said lower wall, to allow the drainage of liquids.

4. The dispenser of claim 1, wherein:

said lower wall and said lateral walls are in one piece and said cover and said pushing assembly are separable from said container;

on at least one of the opposite lateral walls of said second pair of lateral walls, there is provided a cutout, closed by a transparent sheet, adapted to allow adapted to allow viewing of the inside, on the inner side of the cutout, at the opposite side surfaces of the cutout there being provided vertical runners for the removable insertion of a filling element of the cutout, adapted to at least partially obstruct the view through said cutout; said transparent sheet and said filling element being removable;

said cover comprises a hinging device to said container, in turn comprising wings projecting from said cover at two corner areas thereof, on each wing there being provided a corresponding first hinge part, adapted to be rotatingly coupled to a corresponding second hinge part provided in proximity of said perimeter edge of the container; coupling between said first and second hinge part being of elastically yielding type, to allow the cover to be decoupled from/coupled to the container;

said opposite guides of said pushing assembly comprise upper end-of-travel locking elements for said upper plate;

said container, said cover, said plates, said at least one elastic element, said upper end-of-travel locking elements, said transparent sheet with related said filling element being individually separable to allow washing thereof.

5. The dispenser according to claim 1, wherein said cover is separable from said container.

6. The dispenser according to claim 1, wherein said closing cover comprises an annular stop surface on the upper part of said perimeter edge and a frame that projects downward laterally to said annular stop surface, counter-shaped or complementary to said mouth defined by said perimeter edge.

7. The dispenser of claim 1, wherein said upper plate and said lower plate are provided with respective positioning abutments for the ends of said at least one elastic element.

8. The dispenser according to claim 1, wherein said at least one elastic element is a coil spring.

9. The dispenser according to claim 1, wherein the pushing assembly comprises at least another elastic elements to provide two elastic elements positioned parallel to each other.

10. The dispenser according to claim 1, wherein said upper plate and lower plate are identical and are arranged with identical faces facing each other.

11. The dispenser according to claim 1, wherein said lower wall and said lateral walls are in one piece and said pushing assembly is separable from said container.

12. The dispenser of claim 1, wherein on the inner side of the cutout, at the opposite side surfaces of the cutout there are provided vertical runners for the removable insertion of a filling element of said cutout, adapted to at least partially obstruct the view through said cutout.

13. The dispenser of claim 12, wherein said filling element comprises at least one through slot adapted to allow viewing of the inside of the container.

14. The dispenser according to claim 1, wherein said cover comprises an opening button provided, when the cover is closed, on one said wall of said second pair.

15. The dispenser of claim 14, wherein said button is defined on a tab projecting downward from the perimeter of said cover and is adapted to be inserted in a complementary through impression defined on said wall of said second pair.

16. The dispenser according to claim 1, wherein said cover comprises a hinging device a said container.

17. The dispenser of claim 16, wherein said hinging device comprises wings projecting from said cover at two corner areas thereof, on each wing there being provided a corresponding first hinge part, adapted to be rotatingly coupled to a corresponding second hinge part provided in proximity of said perimeter edge of the container; coupling between said first and second hinge part preferably being of elastically yielding type.

* * * * *